United States Patent [19]

Schelhas

[11] 4,284,048

[45] Aug. 18, 1981

[54] PRESSURE CONTROL VALVE FOR A FUEL INJECTION SYSTEM

[75] Inventor: Peter Schelhas, Stuttgart, Fed. Rep. of Germany

[73] Assignee: Robert Bosch GmbH, Stuttgart, Fed. Rep. of Germany

[21] Appl. No.: 55,125

[22] Filed: Jul. 5, 1979

[30] Foreign Application Priority Data

Aug. 16, 1978 [DE] Fed. Rep. of Germany ..... 2835782

[51] Int. Cl.[3] ..... F02M 39/00; F02M 1/02

[52] U.S. Cl. ..... 123/453; 123/454

[58] Field of Search ..... 123/139 AW, 139 ST, 123/140 MC, 179 L, 139 BG, 452, 453, 454, 455

[56] References Cited

U.S. PATENT DOCUMENTS

| | | | |
|---|---|---|---|
| 4,136,653 | 1/1979 | Knapp | 123/139 AW |
| 4,141,330 | 2/1979 | Schlott | 123/139 AW |
| 4,147,146 | 4/1979 | Wessel | 123/139 AW |
| 4,192,271 | 3/1980 | Peters | 123/139 ST |

*Primary Examiner*—Charles J. Myhre
*Assistant Examiner*—Carl Stuart Miller
*Attorney, Agent, or Firm*—Edwin E. Greigg

[57] ABSTRACT

A pressure control valve for a fuel injection system is proposed which serves to control the warm-up fuel quantity for a mixture-compressing, externally ignited internal combustion engine. The pressure control valve includes a movable valve part which is urged in the closing direction by a compression spring which is counteracted during the warm-up phase by a first temperature-dependent element, whose force on the compression spring below a predetermined temperature in the direction of an increase in the force of the first temperature-dependent element can be influenced by a second temperature-dependent element, so that the fuel-air mixture during the warm-up phase can be adapted to the requirements of every internal combustion engine.

3 Claims, 1 Drawing Figure

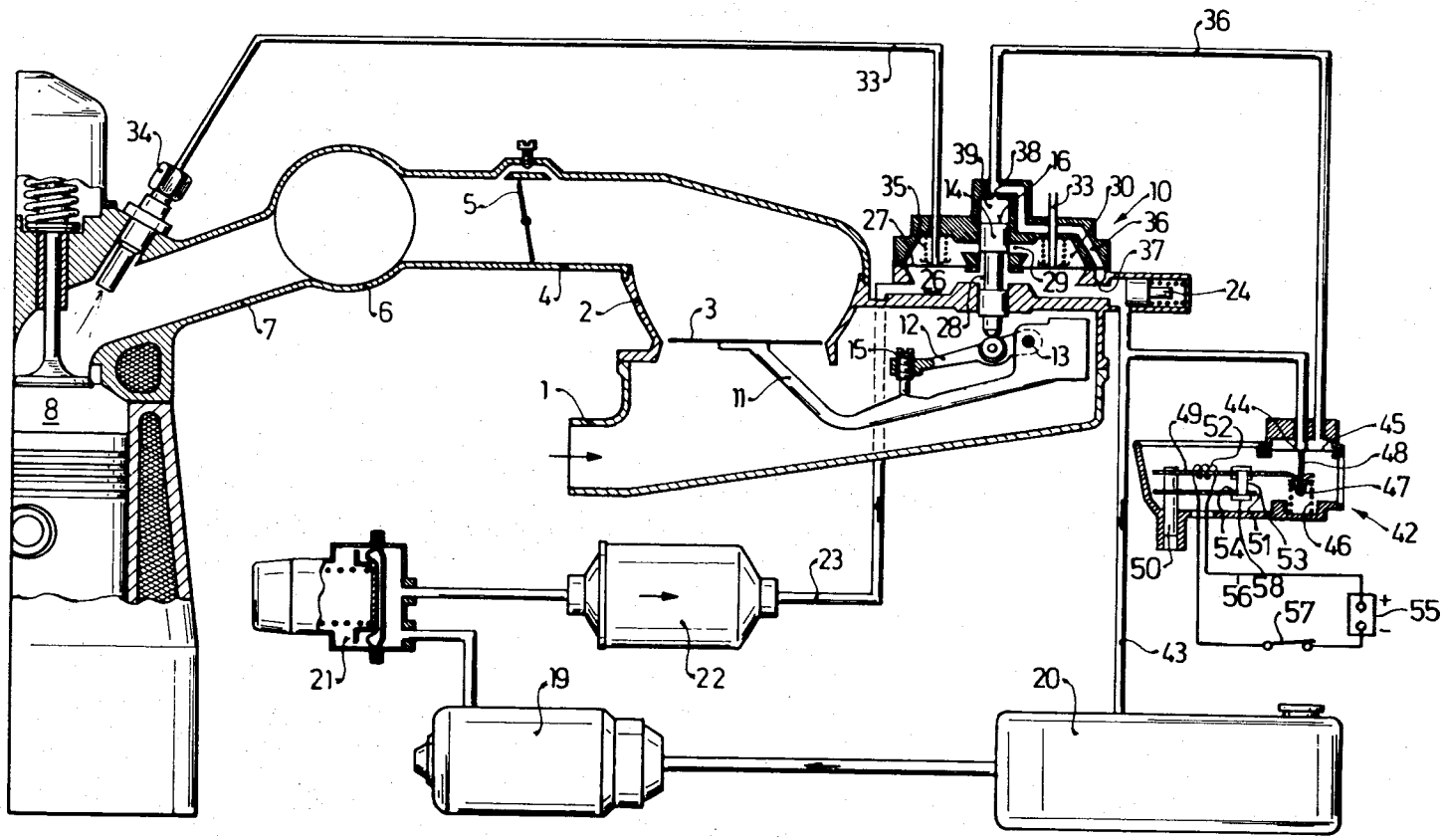
1
2
3
4
5
6
7
8
10
11
12
13
14
15
16
19
20
21
22
23
24
26
27
28
29
30
33
34
35
36
37
38
39
42
43
44
45
46
47
48
49
50
51
52
53
54
55
56
57
58

PRESSURE CONTROL VALVE FOR A FUEL INJECTION SYSTEM

BACKGROUND OF THE INVENTION

The invention relates to a pressure control valve of the type described herein and finally claimed. A pressure control valve is already known for controlling a richer fuel-air mixture during the warm-up phase of the internal combustion engine, in which the reduction of the fuel enrichment during the warm-up phase of the internal combustion engine is delayed. However, at low starting temperatures, this causes a needlessly great fuel enrichment.

OBJECT AND SUMMARY OF THE INVENTION

The pressure control valve in accordance with the invention has the advantage over the prior art that its control performance is better adapted to the requirements of actual conditions.

The invention will be better understood as well as further objects and advantages thereof become more apparent from the ensuing detailed description of a preferred embodiment taken in conjunction with the drawing.

BRIEF DESCRIPTION OF THE DRAWING

The single FIGURE of the drawing shows one exemplary embodiment of the invention which is described in detail below.

DESCRIPTION OF THE PREFERRED EMBODIMENT

In the drawing, there will be seen a fuel injection system including an intake manifold 1 having a conical section 2 which contains an air flow rate member 3 beyond which there is located an induction tube region 4 containing an arbitrarily actuatable throttle valve 5. Intake air flows through the induction tube in the direction of the arrow to a manifold 6 from which it is directed to individual induction tube regions 7 to one or more cylinders 8 of an internal combustion engine.

In the present case, the air flow rate member 3 is a baffle plate disposed transversely with respect to the direction of air flow and capable of displacement within the conical region 2 of the induction tube as an approximately linear function of the air flow rate through the tube. The air pressure between the air flow rate member 3 and the throttle valve 5 will be constant provided that the restoring force acting on the air flow rate member 3 is constant and that the air pressure ahead of the member 3 is also constant. The air flow rate member 3 controls the opening of a metering and distribution valve assembly 10. The motion of the air flow rate member 3 is transmitted by an operating lever 11 which is pivoted on the same shaft 13 as a correction lever 12 and which actuates the control slide 14 which is the movable member of the metering and distribution valve assembly 10. A mixture control screw 15 permits an adjustment of the desired fuel-air mixture. The end face 16 of the control slide 14 remote from the lever 11 experiences the pressure of a control fluid which is exerted onto the air flow rate member 3 and acts as a return force in opposition to the force of the flowing air.

Fuel is supplied by an electric fuel pump 19 which aspirates fuel from a fuel tank 20 and delivers it through a storage container 21, a filter 22 and a fuel line 23 to the fuel metering and distribution assembly 10. A fuel system pressure controller 24 maintains the system pressure in the fuel injection system constant.

The fuel supply line 23 splits into several branches which lead to chambers 26 of the fuel valve assembly 10, whereby one side of a diaphragm 27 in each chamber is affected by fuel pressure. The chambers 26 also communicate with an annular groove 28 of the control slide 14. Depending on the axial position of the control slide 14, the annular groove 28 overlaps control slits 29 to varying degrees permitting fuel to flow into chambers 30 which are divided from the chambers 26 by the diaphragm 27. From the chambers 30, fuel flows through the injection channels 33 to the individual injection valves 34 which are located in the vicinity of the engine cylinders 8 in the induction tube region 7. The diaphragm 27 is the movable valve member of a flat seat valve which is held open by a spring 35 when the fuel injection system is not operating. The diaphragm boxes defined, in each case, by a chamber 26 and a chamber 30, insure that the pressure drop at the metering valve 28, 29 is substantially constant independent of the relative overlap between the annular groove 28 and the control slits 29, i.e., independently of the fuel quantity flowing to the injection valves 34. This insures that the metered out fuel is exactly proportional to the control path of the slide 14.

During a pivoting displacement of the operating lever 11, the air flow rate member 3 is moved into the conical region 2 so that the varying annular cross section between the flow rate member and the conical wall remains proportional to the displacement of the air flow rate member 3. The force which generates the restoring force on the control slide 14 is a pressurized fluid, which, in this case, is fuel. To provide this fluid, a control pressure line 36 branches off from the main fuel supply line 23 via a decoupling throttle 37. The control pressure line 36 communicates via a damping throttle 38 with a pressure chamber 39 into which one end of the control slide 14 extends.

The control pressure line 36 contains a pressure control valve 42 which permits control fluid to return to the fuel tank 20 via a return line 43 without pressure. The pressure control valve 42 permits changing the pressure which produces the restoring force during the warm-up phase of the engine in dependence on time and temperature. The pressure control valve 42 is a flat seat valve having a fixed valve seat 44 and a diaphragm 45 which is loaded in the closure direction by a compression spring 46. The compression spring 46 acts via a spring support 47 and a transmission pin 48 onto the diaphragm 45. When the engine temperature is below the normal operating temperature of ca. 80° C., the spring force 46 acts counter to the force of a first temperature-dependent element in the form of a bimetallic spring 49. The first bimetallic spring 49 is attached at its end remote from the compression spring 46 to a bolt 50, on which a second temperature-dependent element, in the form of a second bimetallic spring 51, is attached as well. Between the first bimetallic spring 49 and the second bimetallic spring 51, a bar-shaped connecting element 53 is disposed, which is firmly connected, for example, with the first bimetallic spring 49 on one end and on the other end passes through an opening 54 of the second bimetallic spring 51 and ends in a stub 58, which has a larger diameter than the opening 54. The first bimetallic spring 49 can be heated by an electric heating coil 52 which acts as a timing member, which is connected to the vehicle battery 55 and whose electrical circuit 56 is closed by the ignition and starting switch 57.

The function of the pressure control valve 42 is as follows. At temperatures above ca. 80° C., the first bimetallic spring 49 has bent so far toward the diaphragm 45 that it is out of engagement with the compression spring 46, so that the control pressure in the pressure control line 36 governed by the pressure control valve 42 is determined exclusively by the force of the compression spring 46. Below an engine operating temperature of ca. 80° C., it is necessary during the warm-up phase of the engine to enrich the fuel-air mixture with fuel. The first bimetallic spring 49 serves this purpose in accordance with the invention by having the capacity to reduce the force exerted by the compression spring 46 on the diaphragm 45. A reduction of the closing force exerted by the compression spring 46 onto the diaphragm 45 causes a reduced control pressure to be set in the control pressure line 36, so that the restoring force exerted on the control slide 14 and thus on the air flow rate member 3 is also reduced, as a result of which, when the induced air quantity remains the same, the control slide 14 is displaced more in the opening direction of the control slits 29 and a larger fuel quantity is apportioned.

The disposition of the two bimetallic springs 49 and 51 for warm-up control in accordance with the invention offers the advantage that the course of the mixture enrichment during the warm-up phase can be adapted to the requirements of the internal combustion engine. Thus, the second bimetallic spring 51 is embodied in such a manner that below a temperature of ca. 20° C. it assumes with its free end a position with respect to the first bimetallic spring 49 such that it contacts the stub 58 of the connecting element 53 and urges the first bimetallic spring 49, via the connecting element 53, in the direction of an increase in the force of the first bimetallic spring 49 on the compression spring 46. If the temperature rises above ca. 20° C., then the second bimetallic spring 51 bends so far toward the first bimetallic spring 49 that it is lifted from the stub 58 of the connecting element 53 and the compression spring 46 is loaded, until the operating temperature of ca. 80° C. is reached, only by the first bimetallic spring 49. As a result it is possible, during cold starting of the engine below ca. 20° C., that at first a very rich fuel-air mixture is furnished and subsequently, by reducing the force of the second bimetallic spring 51 on the first bimetallic spring 49, the enrichment factor is reduced relatively quickly, because as a result of the earlier running of the engine the cylinder walls have already been prewarmed to such an extent that fuel condensation on the previously cold cylinder walls occurs less and less, until from ca. 20° C. up to the end of the warm-up phase at about 80° C. only a very small fuel enrichment takes place as a result of the first bimetallic spring 49. The course of the deregulation curve of the pressure control valve 42 can be affected by the selection of the two bimetallic springs 49 and 51 and by the embodiment of the electrical heating element which may be, for example, embodied as an electrical heating coil.

The foregoing relates to a preferred exemplary embodiment of the invention, it being understood that other embodiments and variants thereof are possible within the spirit and scope of the invention, the latter being defined by the appended claims.

What is claimed and desired to be secured by letters patent of the United States is:

1. A pressure control valve for a fuel injection system of a mixture-compressing, externally ignited internal combustion engine having an intake manifold provided with an air flow rate member which is moved in accordance with the quantity of air flowing therethrough against a restoring force generated by a constant pressure fluid which is arbitrarily variable by means of said pressure control valve having a movable element, said pressure being supplied into a control pressure line against a face of said movable element, said movable element having another face acted upon by action of a compression spring, the force of said compression spring being arranged to be reduced by at least a first temperature-dependent element, said pressure control valve further including a second temperature-dependent element which may influence the force of the first temperature-dependent element on the compression spring, further wherein a rigid connecting element is disposed between said first and second temperature-dependent elements, said rigid connecting element being affixed at one end to at least one of said temperature-dependent elements, whereby said rigid connecting element provided between said first and second temperature-dependent elements engages said first temperature-dependent element and urges said first temperature-dependent element in the direction of an increase in the force of said first temperature-dependent element on said compression spring only below a predetermined temperature.

2. A pressure control valve in accordance with claim 1, further wherein an electrical heating element is disposed at least on said first temperature-dependent element, the electrical circuit of which is closed by means of an ignition and starting switch of the internal combustion engine.

3. A pressure control valve in accordance with claim 2, further wherein said first and second temperature-dependent elements comprise bimetallic springs.

* * * * *